US011178495B2

(12) United States Patent
Iwakura

(10) Patent No.: US 11,178,495 B2
(45) Date of Patent: Nov. 16, 2021

(54) ELECTROMECHANICAL TRANSDUCER AND ELECTROACOUSTIC TRANSDUCER

(71) Applicant: RION CO., LTD., Kokubunji (JP)

(72) Inventor: Takashi Iwakura, Kokubunji (JP)

(73) Assignee: RION CO., LTD., Tokyo (JP)

( * ) Notice: Subject to any disclaimer, the term of this patent is extended or adjusted under 35 U.S.C. 154(b) by 0 days.

(21) Appl. No.: 17/051,135

(22) PCT Filed: Apr. 18, 2019

(86) PCT No.: PCT/JP2019/016709
§ 371 (c)(1),
(2) Date: Oct. 27, 2020

(87) PCT Pub. No.: WO2019/208400
PCT Pub. Date: Oct. 31, 2019

(65) Prior Publication Data

US 2021/0235199 A1 Jul. 29, 2021

(30) Foreign Application Priority Data

Apr. 27, 2018 (JP) ..... JP2018-087211

(51) Int. Cl.
*H04R 19/00* (2006.01)
*H04R 9/00* (2006.01)
*H04R 11/02* (2006.01)

(52) U.S. Cl.
CPC ..... *H04R 11/02* (2013.01)

(58) Field of Classification Search
CPC . H04R 9/04; H04R 9/041; H04R 7/04; H04R 9/025; H04R 9/046
(Continued)

(56) References Cited

U.S. PATENT DOCUMENTS 6,075,870 A 6/2000 Geschiere et al.
2015/0207392 A1* 7/2015 Iwakura ..... H04R 11/02 310/25
2017/0244309 A1 8/2017 Iwakura

FOREIGN PATENT DOCUMENTS

JP 2007074499 A 3/2007
JP 5653543 B1 11/2014
JP 2017152903 A 8/2017

OTHER PUBLICATIONS

International Search Report and Written Opinion for related JP App. No. PCT/JP2019/016709 dated Jun. 18, 2019. English translation provided; 6 pages.

* cited by examiner

*Primary Examiner* — George C Monikang
(74) *Attorney, Agent, or Firm* — Procopio, Cory, Hargreaves & Savitch LLP

(57) ABSTRACT

The electromechanical transducer is provided with: a structure portion in which a magnet, yokes, and a coil are integrally arranged; an armature which includes an inner portion penetrating through an internal space of the structure portion along a central axis in the X-direction, and outer portions, constitutes a magnetic circuit with the structure portion, and is displaced in the Z-direction; and elastic members providing the armature with a recovery force. Each of the elastic members has a first and a second engaging portions. A width in which a force in the Z-direction acts between each of the elastic members and the structure portion via the first engaging portion has a first distance. A width between each of the elastic members and the outer portion via the second engaging portion has a second distance in the Y-direction, wherein the dimension condition of 2a>2×2b is set.

8 Claims, 9 Drawing Sheets

(58) Field of Classification Search
USPC ..... 381/116, 117, 191
See application file for complete search history.

ELECTROMECHANICAL TRANSDUCER AND ELECTROACOUSTIC TRANSDUCER

CROSS-REFERENCE TO RELATED APPLICATIONS

This application is a U.S. National Stage entry of PCT Application No. PCT/JP2019/016709, filed on Apr. 18, 2019, which claims priority to JP Application No. 2018-087211, filed Apr. 27, 2018. The contents of the foregoing are incorporated by reference.

TECHNICAL FIELD

The present invention relates to an electromechanical transducer for converting an electric signal into mechanical vibration and an electroacoustic transducer for converting an electric signal into sound. Particularly, it relates to an electromechanical transducer provided with a driving portion including an armature, yokes, a coil, magnets, etc. and an electroacoustic transducer.

BACKGROUND ART

A balanced armature type electroacoustic transducer which is provided with an armature, yokes, a coil, magnets, etc., is configured to drive the armature in accordance with an electric signal supplied to the coil, thereby converting relative vibration between the armature and another member into sound. For example, a structure in which the armature is positioned with respect to the yokes through spring members has been proposed (e.g. see PTL 1). As shown in FIG. 3 and FIG. 4 of PTL 1, a pair of upper and lower spring members that are engaged with the armature are interposed between the yokes. Accordingly, the flexibility for designing the armature is increased so that the structure can be small in size and make a high output. In order to secure sufficient performance in the case where the aforementioned structure is used, the position of the armature relative to the positions of the yokes is required to be properly determined. Therefore, the role of the spring members which are placed between the armature and the yokes is important.

CITATION LIST

Patent Literature

PTL 1: Japanese Patent No. 5653543

SUMMARY OF INVENTION

Technical Problem

As to the position of the armature in the case in which the structure of PTL 1 is used, gaps between the armature and the magnets arranged above and under the armature are made as equal as possible. In addition to that, it is desirable that the armature rotates without tilting with respect to a central axis extending in an X-direction (which will be hereinafter simply referred to as "central axis"). The X-direction is a longitudinal direction of the armature. Although the aforementioned structure of PTL 1 is effective in positioning the up/down direction of the armature, an effect of suppressing the tilting of the armature with respect to the central axis is still insufficient. Specifically, with reference to FIG. 4 of PTL 1, in each of the spring members, upper and lower portions that are engaged with the yoke and the armature are substantially equal in dimension to each other. Normally, the spring members are disposed in a deflected state. Since the spring members are machined components, the shapes of the spring members may however vary from one another to some degree. For this reason, the spring members are not uniformly deflected. As a result, the armature rotates to tilt with respect to the central axis, so that there is a problem that the air gaps cannot be parallel gaps. In the state in which the armature has tilted, there is a possibility of being unable to obtain desired performance in the electromechanical transducer, or a possibility of a decrease in yield due to the variation of the performance. In particular, in a case where the size of the electromechanical transducer is increased to enlarge the width of the armature, it will be a big problem that the armature tilts more easily.

The present invention has been accomplished in order to solve these problems. An object of the present invention is to provide an electromechanical transducer using a structure in which an armature is positioned with respect to a yoke through spring members, so that the armature can be inhibited from tilting with respect to a central axis to thereby secure good performance and a high flexibility on the structure.

Solution to Problem

In order to solve the foregoing problems, the present invention provides an electromechanical transducer that converts an electric signal into mechanical vibration, the electromechanical transducer including:

a structure portion in which at least a pair of magnets (15), a yoke (10, 11) and a coil (12) are integrally arranged, the yoke guiding magnetic fluxes generated by the magnets, the electric signal being supplied to the coil;

an armature (13) in which an inner portion (13*a*) penetrating an internal space of the structure portion along a central axis extending in a first direction (X-direction), and outer portions (13*b*) protruding from opposite sides of the inner portion are formed, and that configures a magnetic circuit with the structure portion through two regions of the inner portion to which the magnetic fluxes reverse to each other are guided so that the armature is displaced in a second direction (Z-direction) orthogonal to the first direction by magnetic force of the magnetic circuit; and elastic members (14*a*, 14*b*, 14*c* and 14*d*) that are arranged symmetrically to each other in the second direction across each of the outer portions on the opposite sides to give restoring forces respectively to the outer portions in accordance with the displacement of the armature generated by the magnetic force of the magnetic circuit.

A first engagement portions (E1) engaged with the structure portion and second engagement portions (E2) engaged with each of the outer portions are formed in each of the elastic members. When a direction perpendicular to the first direction and the second direction is set as a third direction (Y-direction), a width on which a force in the second direction acts between each of the elastic members and the structure portion trough each of the first engagement portions has a first distance (2b) in the third direction, a width on which a force in the second direction acts between each of the elastic members and each of the outer portions through the second engagement portions has a second distance (2a) in the third direction, and the second distance is set to be two times or more than the first distance. Thus, a moment around the central axis of the armature generated by the forces between the elastic members and the structure member is reduced and the second distance is increased. Consequently, the armature is made difficult to rotate around the central axis.

According to the electromechanical transducer according to the present invention, each of the elastic members is engaged with the structure portion through the first engagement portion and engaged with each of the outer portions of the armature through the second engagement portion. When the armature positioned at a predetermined position is relatively displaced by the magnetic force caused by a coil current, the elastic members give restoring forces to the armature. In each of the elastic members, on which forces symmetric with respect to the central axis of the armature act, the relationship of $2a>2\times2b$ is set about the first distance (2b) which is the width on which the force between the elastic member and the structure portion acts, and the second distance (2a) which is the width on which the force between the elastic member and the outer portion acts. Thus, tilting of the armature with respect to the central axis can be suppressed. Consequently, deterioration of performance caused by the tilting of the armature in the electromechanical transducer etc. can be surely prevented while the flexibility for designing the armature is enhanced.

Further, in order to solve the foregoing problems, the present invention provides an electromechanical transducer that converts an electric signal into mechanical vibration, the electromechanical transducer being configured to include the same structure portion, the same armature, and the same elastic members as the aforementioned ones. Assume that a region including each of the elastic members, the structure portion and each of the outer portions is divided into a first region and a second region by a plane including the central axis and parallel to the first direction and the second direction, and a direction perpendicular to the first direction and the second direction is set as a third direction. In this case, when the force acting in the second direction between each of the elastic members and the structure portion through the first engagement portion is expressed by a first resultant force acting on a first application point of the first region and a second resultant force acting on a second application point of the second region, and the force acting in the second direction between each of the elastic members and each of the outer portions through the second engagement portions is expressed by a third resultant force acting on a third application point of the first region and a fourth resultant force acting on a fourth application point of the second region, a second distance between the third application point and the fourth application point is set to be two times or more than a first distance between the first application point and the second application point in the third direction. Even by such a structure, the same functions and effects of the present invention as the aforementioned ones can be realized.

In the present invention, anchor members can be attached to opposite sides in the first direction of the yoke, the elastic members being engaged through the first engagement portions respectively. Thus, the width of each of the portions of the yoke with which the elastic member is engaged does not have to be reduced in accordance with the width of the first engagement portion. Therefore, the elastic members can be engaged through the anchor members respectively without thickening the yoke, advantageously in terms of easy machining and downsizing. For example, each of the anchor members may be formed into an approximately rectangular sectional shape having a width equal to the first distance.

In the present invention, cutout portions with which the elastic members are engaged through the second engagement portions can be formed at positions symmetric with respect to a plane including the central axis and the second direction and in the outer portions on the opposite sides of the a mature. Thus, it is unnecessary to provide any special dedicated members because the cutout portions are formed in the armature itself. Further, according to the structure, positioning between the armature and the elastic members is easy, and the armature and the elastic members are easy to be assembled.

In the present invention, a pair of spring members each formed by bending a plate-like member can be used as the elastic members. Elastic forces of the spring members are set suitably so that the elastic members can give desired restoring forces.

Further, in order to solve the foregoing problems, the electroacoustic transducer according to the preset invention is configured to include any of the aforementioned electromechanical transducers, and a diaphragm that generates sound pressure according to vibration generated by the electromechanical transducer. The electroacoustic transducer according to the present invention can also obtain the same functions and effects as those of the aforementioned electromechanical transducer,

Advantageous Effects of Invention

According to the present invention, each of the elastic members which gives the restoring force to the armature in accordance with the displacement is engaged with the structure portion and a corresponding one of the outer portions of the armature, and the relationship between the distances each extending between the application points of the two resultant forces and having symmetry with respect to the central axis is defined as the dimensional condition. Thus, the structure in which the armature is difficult to tilt with respect to the central axis can be realized. Consequently, it is possible to realize the electromechanical transducer etc. which can effectively prevent performance deterioration caused by the tilting of the armature, so as to create more options for selecting the elastic members and to secure high yield and good performance while making flexibility for designing the structure.

DESCRIPTION OF EMBODIMENT

Figure 1:
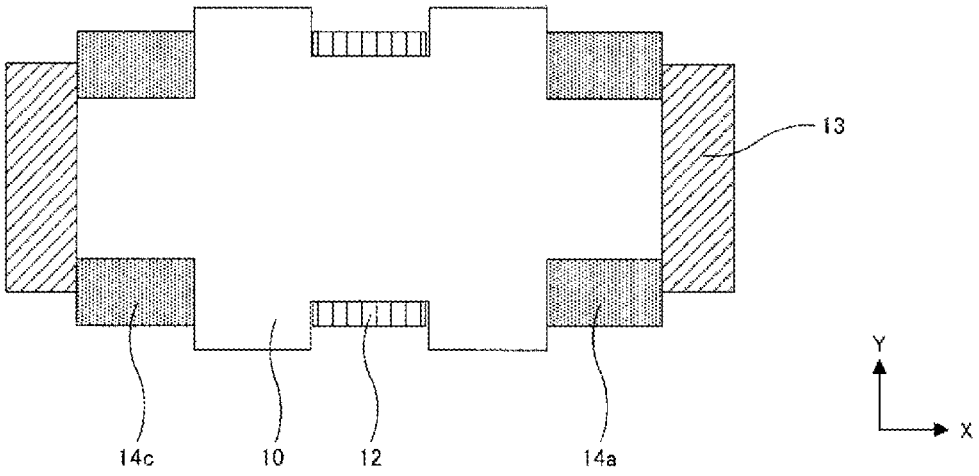
FIG. 1 A top view of a driving portion in an electromechanical transducer according to the present embodiment as seen from one side in a Z-direction.
Figure 2:
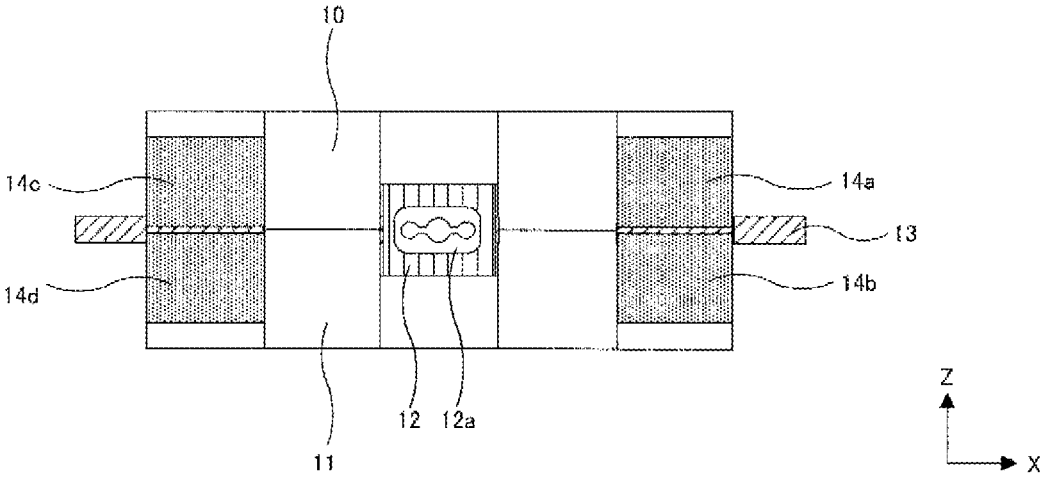
FIG. 2 A front view of the driving portion in the electromechanical transducer in FIG. 1 as seen from one side in a Y-direction.

A preferred embodiment of the present invention will be described with reference to the drawings. However, the embodiment which will be described below is merely an example of a mode to which the present invention is applied. Therefore, the present invention is not limited by the contents of the present embodiment. The embodiment in which the present invention is applied to an electromechanical transducer for converting an electric signal into mechanical vibration and an electroacoustic transducer for converting an electric signal into sound will be described below.

A basic structure of the electromechanical transducer according to the present embodiment will be described below with reference to FIGS. 1 to 4. In FIGS. 1 to 4, an X-direction (first director according to the present invention), a Y-direction (third direction according to the present invention), and a Z-direction (second direction according to the present invention) which are orthogonal to one another are respectively designated by arrows. The electromechanical transducer according to the present embodiment does not need to define up, down, left, and right directivities. However, in some cases, the up, down, left and right directions will be mentioned below according to the directions (X, Y, Z) in each of planes (paper surfaces) of the drawings for convenience of description.

A pair of yokes 10 and 11, a coil 12, an armature 13, four spring members 14*a*, 14*b*, 14*c*, and 14*d* (which may be hereinafter simply generically referred to as spring members 14) and two pairs of (four) magnets 15 that constitute a driving portion in the electromechanical transducer according to the present embodiment are shown in FIGS. 1 to 4. Of the driving portion, the pair of yokes 10 and 11, the coil 12 and the four magnets 15 are integrally arranged to function as a structure portion according to the present invention. That is, the armature 13 penetrating an internal space of the structure portion is arranged so as to be movable with respect to the structure portion through the two pairs of spring members 14 on opposite sides. The driving portion itself according to the present invention is an electromechanical transducer so that various application is available. Although not shown in the present embodiment, for example, opposite ends of the armature 13 of the driving portion are fixed to a housing so that the whole of the driving portion can be integrally arranged in the housing to be configured as a vibrator used in a hearing aid, an audio equipment, or the like.

The pair of yokes 10 and 11 are integrally fixed, for example, by welding in a state where the upper yoke 10 and the lower yoke 11 are arranged to face each other in the Z-direction. For example, a soft magnetic material such as a Permalloy containing 45% Ni can be used as the material of the yokes 10 and 11. Further, the air-core coil 12 is arranged at the center of inner surface sides made by the upper and lower yokes 10 and 11 to be sandwiched. A through hole which a opened in the X-direction is formed in the coil 12, and a pair of electrodes 12*a* (see FIG. 2) provided at opposite ends in the Y-direction are electrically connected to the coil 12. The coil 12 is fixed to the inner surface sides of the yokes 10 and 11 with an adhesive agent.

Figure 4:
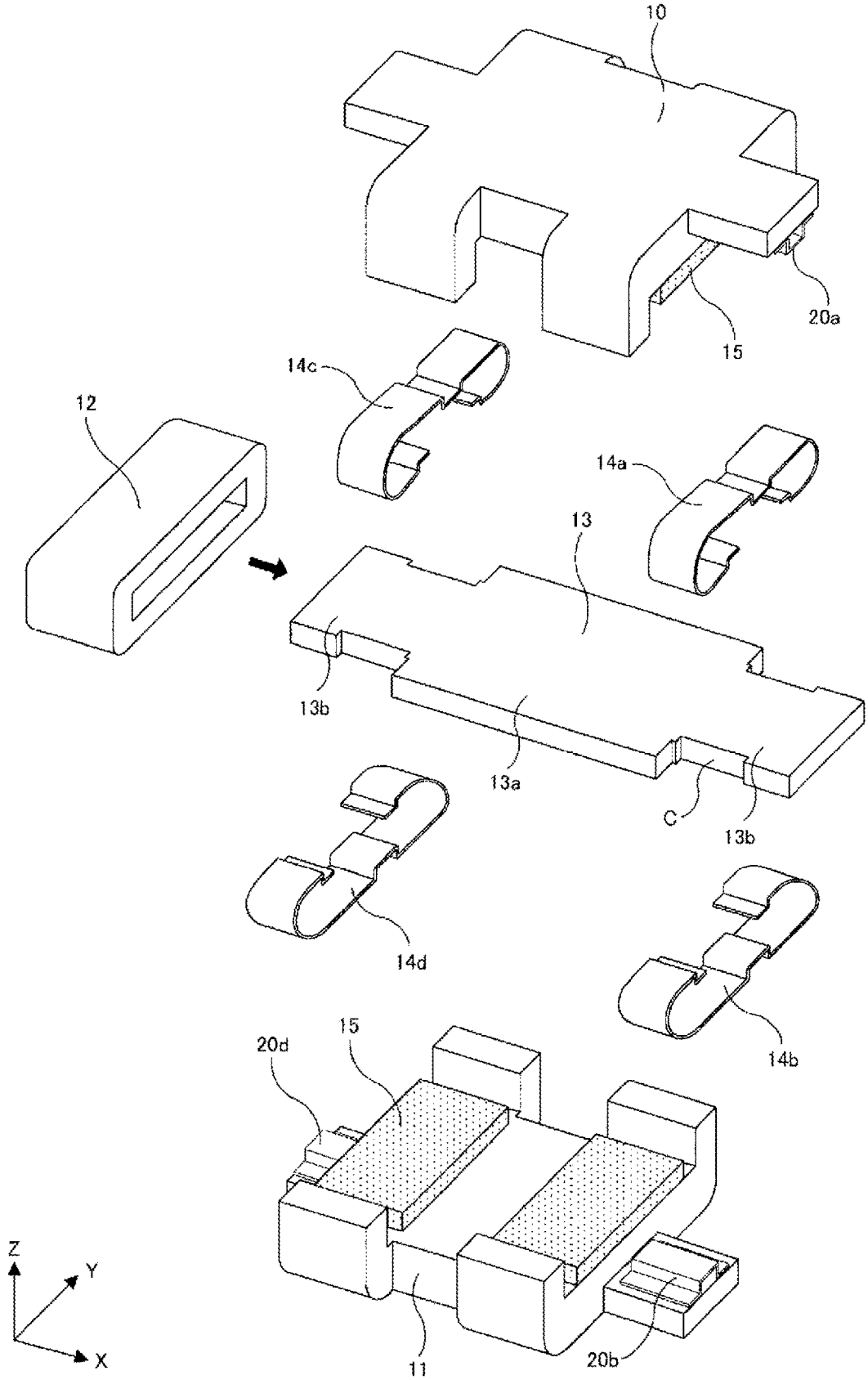
FIG. 4 An exploded perspective view of a range including a magnetic circuit portion and spring members in the electromechanical transducer according to the present embodiment.

As shown in FIG. 4, the four plate-like magnets 15 are symmetrically arranged at opposite end portions in the X-direction on the inner surface sides of the yokes 10 and 11. That is, a pair of magnets 15 facing each other vertically and located on one end side of the yokes 10 and 11 in the X-direction, and a pair of magnets 15 facing each other vertically and located on the other end side of the yokes 10 and 11 in the X-direction are adhesively fixed to the inner surface sides of the yokes 10 and 11 respectively. In addition, a space which is formed between each of the pairs of magnets 15 facing each other forms a part of a magnetic circuit which will be described later.

Anchor members 20*a*, 20*b*, 20*c* and 20*d* (which may be hereinafter simply generically referred to as anchor members 20) are fixed to portions of the yokes 10 and 11 which protrude on the opposite sides in the X-direction from the positions of the magnets 15. Each of the anchor members 20 which is formed, for example, by bending a thin plate-like member made of a material such as SUS 304 has a sectional structure in which the center of the anchor member in the Y direction protrudes in a convex shape, incidentally, the role of the anchor members is to engage the spring members 14*a* to 14*d* with the yokes 10 and 11, but the details will be described later. Here, instead of providing the anchoring members 20, each of the yokes 10 and 11 may be formed into a shape which can be directly engaged with corresponding ones of the spring members 14*a* to 14*d*. However, of the yokes 10 and 11 having such a structure, portions engaged with the spring members 14*a* to 14*d* have to be reduced in width. Therefore, the yokes 10 and 11 have to be thick enough not to be deformed by forces received from the spring members 14*a* to 14*d*. When the anchor members 20 are provided, the yokes 10 and 11 can be still made relatively thin, advantageously in terms of easy machining and downsizing.

The armature 13 which is a flat plate-like member long in the X-direction is arranged to respectively penetrate the space between the pair of magnets 15 on the one end side in the X-direction, the through hole of the coil 12, and the space between the pair of magnets 15 on the other end side in the X-direction. In a state in which the coil 12 has been arranged on the center of the armature 13, parallel gaps are formed between the armature 13 and the two pairs of (four) magnets 15, and the respective gaps constitute air gaps G1 to G4 (see FIG. 5). The air gaps G1 to G4 located at four places are equal in size and shape to one another. When the armature 13 is displaced in the Z-direction within the range of normal operation, the gaps are formed to be appropriate enough to prevent the armature 13 from making contact with the coil 12 and the magnets 15. In the present embodiment, the structure portion including the yokes 10 and 11, the coil 12 and the two pairs of (four) magnets 15 and the armature 13 integrally constitute the magnetic circuit. The configuration and effects of the magnetic circuit will be described later.

The armature 13 includes an inner portion 13*a* and outer portions 13*b*. The inner portion 13*a* penetrates the space (the internal space of the structure portion) facing the yokes 10 and 11. The outer portions 13*b* protrude from opposite sides of the inner portion 13*a* respectively. The inner portion 13*a* is formed as a rectangular portion which is approximately the same in width as that of each of the magnets 15 in the Y-direction. Each of the outer portions 13*b* is formed to be narrower in width than the inner portion 13*a* in the Y-direction. Further, a total of two pars of (four) cutout portions C obtained by partially cutting out opposite sides in the Y-direction of the two outer portions 13*b* nearby the inner portion 13*a* are formed in the outer portions 13*b*. The role of the cutout portions Cis to engage the spring members 14*a* to 14*d* with the armature 13, but details will be described later. For example, a soft magnetic material such as a Permalloy containing 45% Ni can be used as the material of the armature 13, similarly to the yoke 10, 11.

Each of the four spring members 14 (elastic members according to the present invention) is made of a plate spring formed by bending a plate-like member. On one end side in the X-direction, the pair of spring members 14*a* and 14*b* are attached to be arranged symmetrically to each other in the Z-direction across one of the outer portions 13*b* of the armature 13. On the other end side in the X-direction, the pair of spring members 14*c* and 14*d* are attached to be arranged symmetrically to each other in the Z-direction across the other outer portion 13*b* of the armature 13. The spring members 14 function in giving the armature 13 restoring forces proportional to the magnitude of a displacement of the armature 13 when the armature 13 is displaced in the Z-direction relatively to the structure portion inside the magnetic circuit. For example, a stainless steel material such as SUS 301 can be used as the material of the spring members 14.

Figure 5:
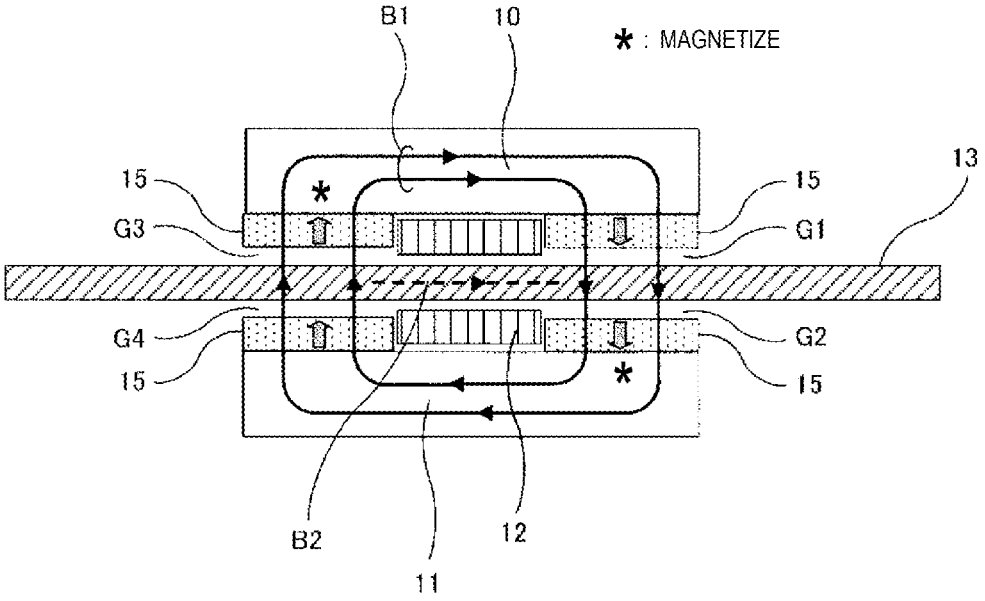
FIG. 5 A view schematically showing a section of a structure portion and an armature constituting the magnetic circuit portion.

A basic operation as the aforementioned magnetic circuit in the electromechanical transducer according to the present embodiment will be described here. FIG. 5 is a view schematically showing a section of a range including the yokes 10 and 11, the coil 12, the armature 13 and the four magnets 15 which constitute the magnetic circuit portion of the electromechanical transducer. Illustration of other members which do not constitute the magnetic circuit portion is omitted. The pair of magnets 15 on the left side of FIG. 5 are magnetized upward, and the pair of magnets 15 on the right side of FIG. 5 are magnetized downward, as designated by the thick arrows. By the four magnets 15 magnetized thus, magnetic fluxes B designated by solid line arrows are generated in the yokes 10 and 11 and the armature 13. In the armature 13, a region sandwiched between the two magnets 15 on the left side and a region sandwiched between the two magnets 15 on the right side correspond to, of the inner portion 13*a*, two regions to which the magnetic fluxes B1 reverse to each other are guided.

Magnetic forces generated by, of the magnetic fluxes B1, magnetic fluxes passing through the aforementioned air gaps G1 to G4 act on the armature 13. Specifically, an upward force acts on the armature 13 when the magnetic forces of the upper-side gaps G1 and G3 become strong, and a downward force acts on the armature 13 when the magnetic forces of the lower-side gaps G2 and G4 become strong. In a case where the four forces are not balanced, the armature 13 is displaced to the stronger side of the magnetic forces. The armature 13 is assembled in such a manner that the aforementioned four forces are balanced when no current flows through the coil 12. On this occasion, the magnetic flux passing through the gap G1 and the magnetic flux passing through the gap G2 are substantially equal to each other, and the magnetic flux passing though the gap G3 and the magnetic flux passing through the gap G4 are also substantially equal to each other, so that no net magnetic flux flows into a portion of the armature 13 surrounded by the coil 12.

When a current is applied to the coil 12 in this state, for example, a magnetic flux B2 designated by a dashed line arrow in FIG. 5 is generated in the inner portion 13*a* of the armature 13 in accordance with a direction of the coil current. On this occasion, when the directivities of the magnetic fluxes B1 and B2 in FIG. 5 are taken into consideration, the magnetic fluxes of the upper-side gaps G1 and G3 decrease respectively and the magnetic fluxes of the lower-side gaps G2 and G4 increase respectively due to the generation of the magnetic flux B2. Therefore, the armature 13 receives a downward magnetic force to be displaced downward. As a result, a restoring force to return the downwardly displaced armature 13 to an original position acts due to the four spring members 14 so that the armature 13 is statically displaced to a position where the restoring force and the magnetic force are balanced. A state in which the armature 13 receives an upward magnetic force to be displaced upward may be assumed when the coil current is reverse in direction to the aforementioned one.

Here, relative vibration between the armature 13 and the structure portion including the yokes 10 and 11, the coil 12 and the four magnets 15 is generated by a driving force generated in accordance with the aforementioned coil current. When the opposite ends of the armature 13 are fixed to the housing with sufficient rigidity, the driving force generated between the armature 13 and the structure portion is transmitted to the housing through the armature 13 to thereby generate vibration. As described above, the electromechanical transducer according to the present embodiment is configured to generate mechanical vibration corresponding to an electric signal applied from the outside.

Figure 7:
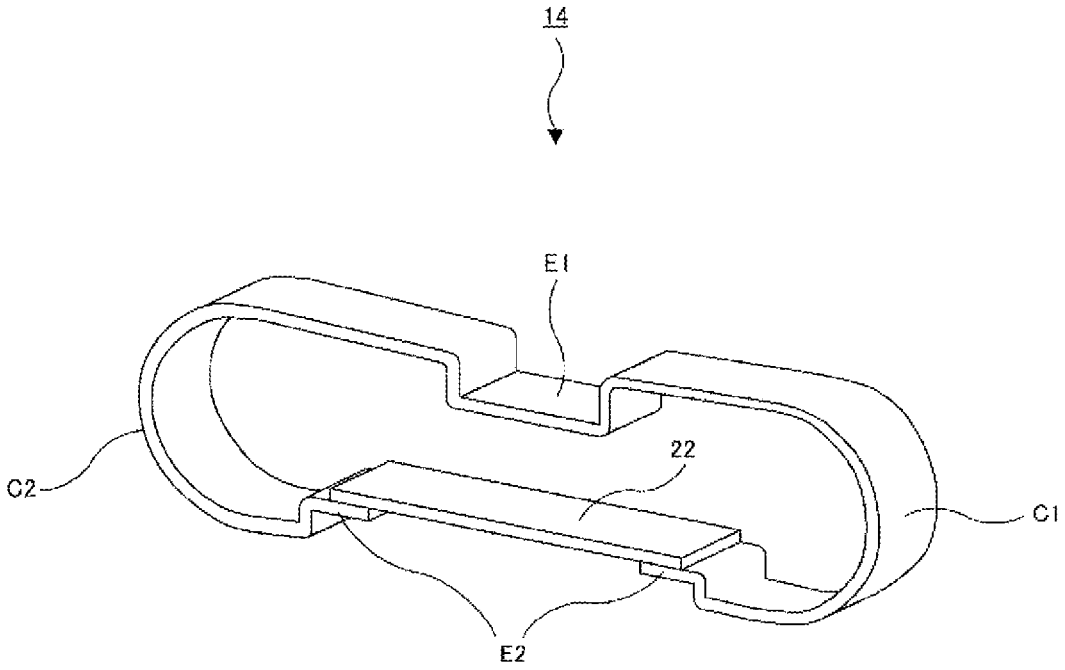
FIG. 7 A perspective view showing an overall structure of a modified example of the spring member.
Figure 8:
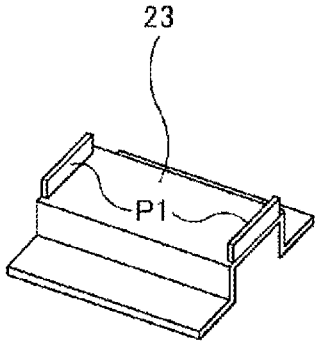
FIG. 8 A view showing a modified example of an anchor member provided in a yoke.

Further, the relationship between the armature 13 and the two pairs of spring members 14 on the opposite sides according to the present embodiment has been described, for example, in PTL 1 (FIG. 7, FIG. 8 and comparative explanation thereof) and both the driving force and the displacement amount are increased so that a small-sized high-power electromechanical transducer can be realized.

Figure 6:
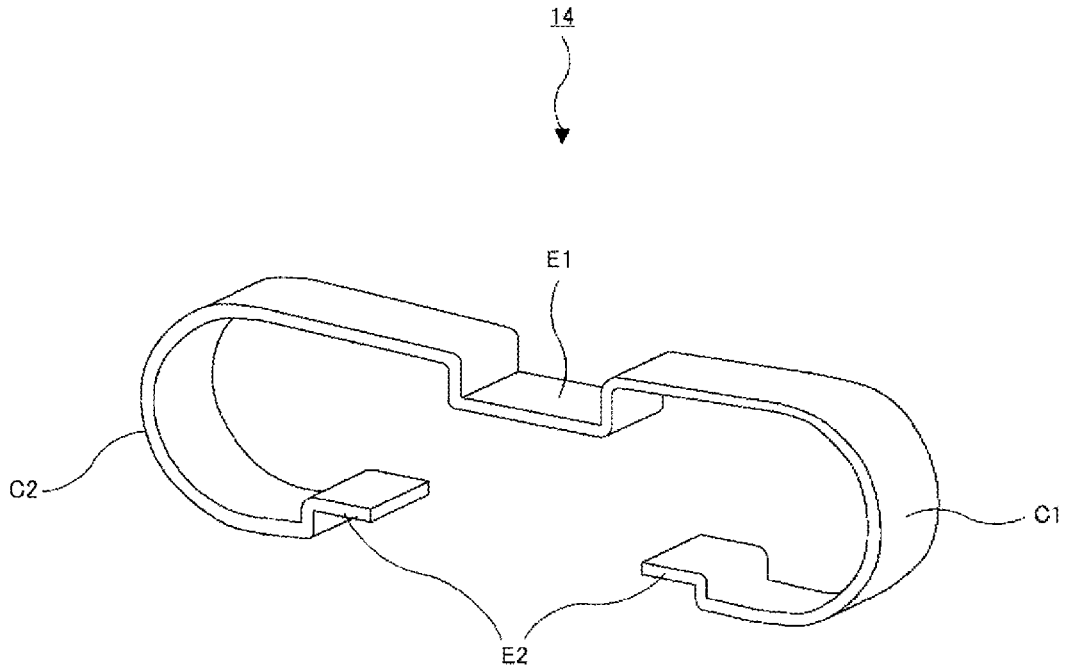
FIG. 6 A perspective view showing an overall structure of the spring member.

Next. FIG. 6 is a perspective view showing a structure example of a spring member 14. The structure in FIG. 6 is shared by the four spring members 14*a*, 14*b*, 14*c* and 14*d* in consideration of the symmetry of the arrangement. As shown in FIG. 6, the spring member 14 includes two curved portions C1 and C2 on the opposite sides in the Y-direction, an engagement portion E1 that is engaged with the anchor member 20*a* to 20*d* of the yoke 10, 11, and a pair of engagement portions E2 that are engaged with the cutout portions C of the outer portion 13*b* of the armature 13. The engagement portion E1 has a structure of one inward recess whereas the pair of engagement portions E2 have a structure of a pair of distal end portions of a plate spring which are bent inward to form L-shapes so as to face each other. Thus, the spring member 14 which has been incorporated into the electromechanical transducer according to the present embodiment is sandwiched between the armature 13 and the anchor member 20 through the engagement portions E1 and E2. The anchor member 20 is provided on each of the yokes 10 and 11 arranged on the upper and lower sides in the Z-direction. In this case, the spring member 14 is retained in a slightly compressed state in the Z-direction, but movements of the spring member 14 in the X-direction and the Y-direction are restricted by the shapes of the engagement portions E1 and E2, the cutout portions C, and the anchor member 20.

The spring member 14 is not limited to the structure example of FIG. 6, and various modifications can be made on the spring member 14. For example, a structure of a modified example of FIG. 7 can be used as the spring member 14. The modified example of FIG. 7 has a structure in which a reinforcement plate 22 is attached to the pair of engagement portions E2 of the spring member 14 so that the entire spring member 14 is shaped like one continuous ring. In the present modified example, by the reinforcement plate 22 provided thus, the spring member 14 is hardly deformed in the Y-direction. Accordingly, the size between the pair of engagement portions E2 can be kept constant. The reinforcement plate 22 is a rectangular plate-like member having a thickness substantially equal to that of the spring member 14. For example, by welding opposite end portions of the reinforcement plate 22 to inner side surfaces of the pair of engagement portions E2, the reinforcement plate 22 is attached to the spring member 14.

Moreover, the anchor member 20 provided on the yoke 10, 11 can be also modified variously. For example, an anchor member 23 shown in FIG. 8 has a structure in which a pair of protrusions P1 protruding in the Z-direction are respectively provided at opposite ends in the X-direction of the anchor member 20 (e.g. see the anchor member 20*b* in FIG. 4). By use of such an anchor member 23, movement of the engagement portion E1 of the spring member 14 in the X-direction can be restricted.

Figure 9:
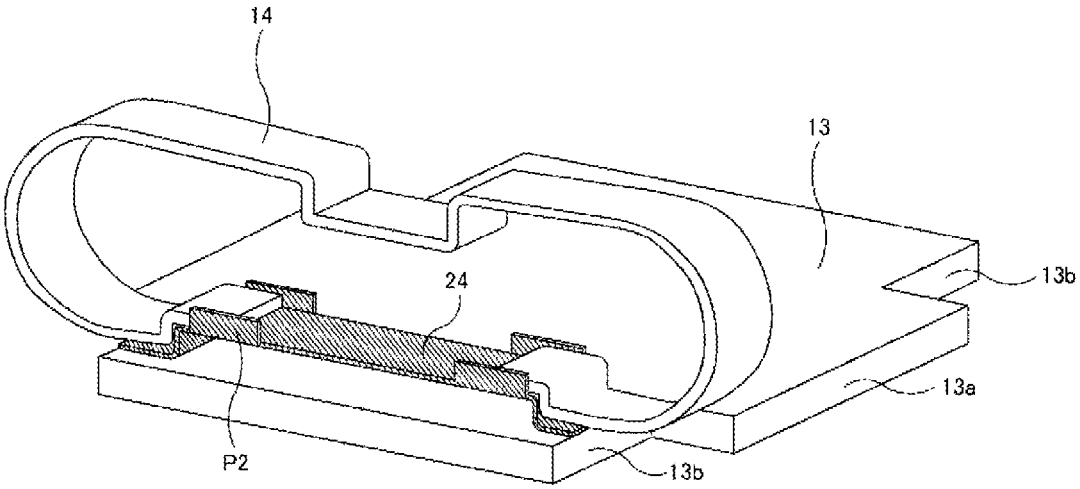
FIG. 9 A view showing a modified example of the structure of the armature corresponding to the spring member.

Furthermore, the structure of the armature 13 corresponding to the spring member 14 having the structure example of FIG. 6 can be also modified variously. For example, FIG. 9 shows a structure in which an anchor member 24 is attached to an armature 13 having a structure in which the cutout portions C (see FIG. 4) are absent from each of outer portions 13*h* protruding from opposite sides of an inner portion 13*a*. The anchor member 24 is fixed to opposite sides in the Z-direction of the outer portion 13*b*, and the pair of engagement portions E2 (see FIG. 6) of the spring member 14 are engaged with opposite ends of a convexly protruding central portion of the anchor member 24. Further, the anchor member 24 is provided with four protruding portions P2 that restrict movement of the pair of engagement portions E2 in the X-direction. Incidentally, a reinforcement plate having the similar function may be provided in place of the anchor member 24. When the anchor member 24 or the reinforcement plate is provided thus on the armature 13, height of each of the L-shaped portions of the spring member 14 can be increased. Thus, a structure in which the spring member 14 hardly comes off can be obtained. Moreover, a distance between the pair of the spring members 14 (e.g. see FIG. 10) facing each other in the up/down direction can be increased so that contact between the spring members 14 can be surely prevented.

Next, a dimensional condition necessary for the spring members 14 etc. as to a measure against tilting of the armature 13 in the present embodiment will be described. The armature 13 is displaced in the Z-direction by the magnetic force of the magnetic circuit. On this occasion, the armature 13 is required to be arranged in parallel with an XY plane. That is, when the armature 13 rotates slightly to tilt with respect to a central axis 13*c* (FIG. 10), the armature 13 cannot obtain desired performance. Accordingly, in order to make it possible to suppress the tilting of the armature 13, it is important to determine the dimensional condition when the spring members 14 have been assembled. A dynamic model for deriving the dimensional condition about the spring members 14, anchor members 20 provided on the yokes 10 and 11 respectively and the armature 13 will be described below as the measure against the tilting of the armature 13 with reference to FIG. 10.

Figure 3:
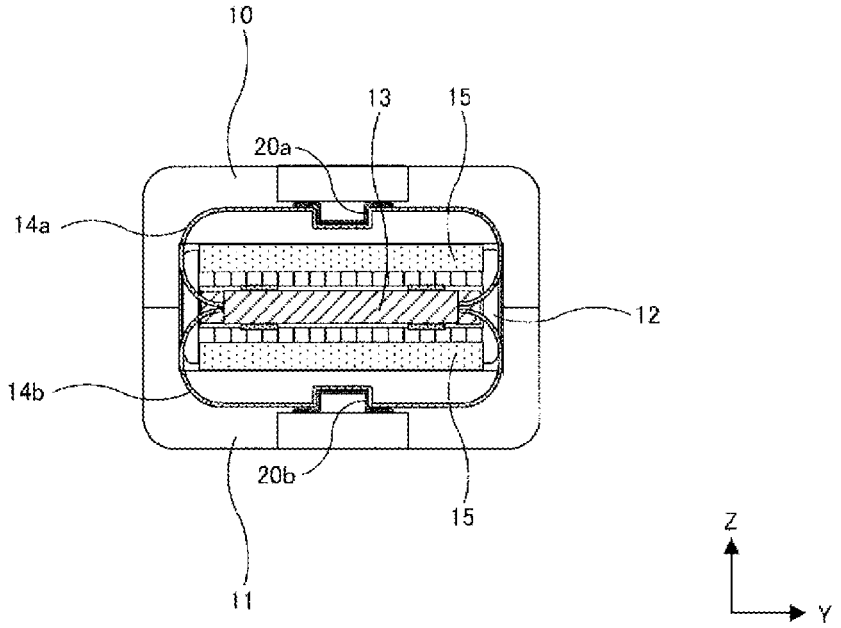
FIG. 3 A side view of the driving portion in the electromechanical transducer in FIG. 1 as seen from one side in an X-direction.
Figure 10:
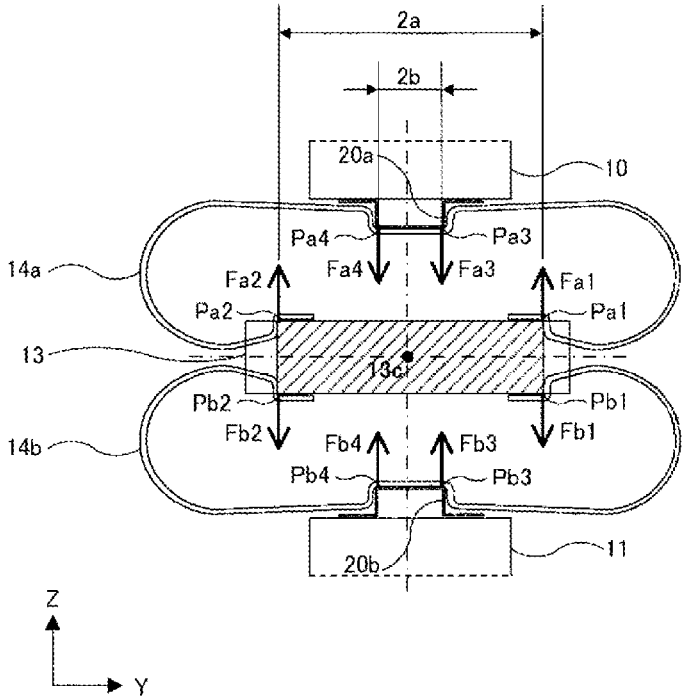
FIG. 10 A view illustrating a dynamic model used for examination about tilting of the armature.

FIG. 10 shows a schematic structure in a range including the armature 13, the anchor members 20 provided or the yokes 10 and 11 respectively, and the pair of spring members 14*a* and 14*b* as seen from the same direction as that of FIG. 3. Here, four forces Fa1, Fa2, Fa3 and Fa4 acting on the upper spring member 14*a* and four forces Fb1, Fb2, Fb3 and Fb4 acting on the lower spring member 14*b*, as designated by arrows in FIG. 10, are modeled. That is, the forces Fa1, Fa2, Fb1 and Fb2 are forces acting on the spring members 14*a* and 14*b* from the armature 13, and the forces Fa3, Fa4, Fb3 and Fb4 are forces acting on the opposed spring members 14*a* and 14*b* from the anchor members 20*a* and 20*b* of the upper and lower yokes 10 and 11. Further, as shown in FIG. 10, positions (Y-coordinates) of the arrows of the aforementioned forces Fa1 to Fa4 and Fb1 to Fb4 correspond to application points Pa1, Pa2, Pa3, Pa4, Pb1, Pb2, Pb3 and Pb4 respectively.

Here, each of the forces Fa1 to Fa4 and Fb1 to Fb4 is a force actually distributed in a range of a certain area, but is modeled as a resultant force therein. Moreover, an application point of the resultant force is set as a point which is obtained to equalize a moment of a force around the central axis 13*c* of the armature. As a result, a point on which the resultant force acts can be determined as the application point. For example, in the case of the forces Fa3 and Fa4 acting on the spring member 14*a* from the anchor member 20*a* of the upper yoke 10, the forces are concentrated on outer edge portions of the protrusion of the anchor member 20*a* and the recess of the engagement portion E1 in consideration of deflection of the spring member 14*a* in the Z-direction. Accordingly, it is appropriate to treat the positions of the outer edge portions as the application points Pa3 and Pa4. This also applies to the anchor member 20*b* of the lower yoke 11 and the spring member 14*b* (the application points Pb3 and Pb4) with same reasons mentioned above. Further, for example, the forces Fa1, Fa2, Fb1 and Fb2 acting on the spring members 14*a* and 14*b* from the armature 13 are also concentrated on outer edge portions of ranges where the cutout portions C and the engagement portions E2 are engaged with each other respectively in consideration of the deflections of the spring members 14*a* and 14*b* in the Z-direction. Accordingly, it is appropriate to treat the positions of the outer edge portions as the application points Pa1, Pa2, Pb1 and Pb2.

As shown in FIG. 10, it is assumed that the application points Pa1 and Pa2 of the forces Fa1 and Fa2 acting on the spring member 14*a* from the armature 13 are separated from each other by a distance 2a. Further, it is assumed that the application points Pa3 and Pa4 of the forces Fa3 and Fa4 acting on the spring member 14*a* from the anchor member 20*a* of the yoke 10 are separated from each other by a distance 2b. Likewise, the aforementioned distances 2a and 2b are also assumed for the lower spring member 14*b* according to having the symmetry. Incidentally, a group of the following mathematical expressions basically relates to the upper spring member 14*a*, but can be also applied to the other spring members 14*b*, 14*c* and 14*d* in the same manner according to having the symmetry.

First, it is assumed that the mechanical system in FIG. 10 is in a balanced state. From the balance of the forces on the upper spring member 14*a* and the balance of the moments of the forces around the central axis 13*c* of the armature 13, the following expressions (1) and (2) are established.

$$Fa1+Fa2-Fa3-Fa4=0 \quad (1)$$

$$Fa1(a+y1)-Fa2(a-y1)-Fa3(b+y2)+Fa4(b-y2)=0 \quad (2)$$

Likewise, as to the lower spring member 14*b*, the following expressions (3) and (4) are established from the same viewpoint as the expressions (1) and (2).

$$-Fb1-Fb2+Fb3+Fb4=0 \quad (3)$$

$$-Fb1(a+y3)+Fb2(a-y3)+Fb3(b+y4)-Fb4(b-y4)=0 \quad (4)$$

in which y1: a deviation in the Y-direction between a center position of the application points Pa1 and Pa2 and the central axis 13*c* y2: a deviation in the Y-direction between a center position of the application points Pa3 and Pa4 and the central axis 13*c* y3: a deviation in the Y-direction between a center position of the application points Pb1 and Pb2 and the central axis 13*c* y4: a deviation in the Y-direction between a center position of the application points Pb3 and Pb4 and the central axis 13*c*

FIG. 10 shows a case where the y1 to y4 are all 0. Actually, the y1 to y4 are extremely small based on the high quality of manufacturing precision. However, the y1 to y4 are amounts introduced in order to take the influence on the tilting of the armature 13 into consideration.

Further, from the balance of the forces on the armature 13 and the balance of the moments of the forces around the central axis 13*c*, the following expressions (5) and (6) are established.

$$-Fa1-Fa2+Fb1+Fb2=0 \quad (5)$$

$$-Fa1(a+y1)+Fa2(a-y1)+Fb1(a+y3)-Fb2(a-y3)=0 \quad (6)$$

Among the expressions (1) to (6), the reaction forces Fa1, Fa2, Fb1 and Fb2 from the armature 13 are set as unknown numbers. To obtain the reaction forces Fa1, Fa2, Fb1 and Fb2, the following expressions (7), (8), (9) and (10) are derived.

$$Fa1=Fb3\{1-(y1-y2)/a\}+(Fa4-Fa3)\{1-b/a-(y1-y2)/a\}/2 \quad (7)$$

$$Fa2=Fb3\{1-(y1-y2)/a\}+(Fa4-Fa3)\{1+b/a+(y1-y2)/a\}/2 \quad (8)$$

$$Fb1=Fb3\{1-(y1-y2)/a\}+(Fb4-Fb3)\{1-b/a-(y3-y4)/a\}/2 \quad (9)$$

$$Fb2=Fb3\{1-(y1-y2)/a\}+(Fb4-Fb3)\{1-b/a-(y3-y4)/a\}/2 \quad (10)$$

By substituting the aforementioned expressions (7) to (10) into the expressions (5) and (6), the following expressions (11) and (12) are derived.

$$Fa3+Fa4=Fb3+Fb4 \quad (11)$$

$$(Fa4-Fa3+Fb3-Fb4)b-(Fa3+Fa4)y2+(Fb3+Fb4)y4=0 \quad (12)$$

When the mechanical system shown in FIG. 10 is in the balanced state, the expressions (11) and (12) are established among the forces Fa3, Fa4, Fb3 and Fb4.

Here, when N is placed on the left side of the expression (12), the following expression (13) is derived from the expression (11).

$$N=(Fa4-Fa3+Fb3-Fb4)b-(Fa3+Fa4)(y2-y4) \quad (13)$$

The N represents a moment of a force acting on the armature 13 around the central axis 13*c*. In the expression (13), the first term is a moment of a force that acts when there is a difference between the left and right forces, and the second term is a moment of a force which acts when the application points of the left and right forces are biased in the Y-direction with respect to the central axis 13*c*. The bias of the second term is represented by the y2 and the y4, and the mechanical system is normally designed so that the y2 and the y4 are zero. However, since some y2 and y4 actually occur due to assembling as described above, it is important to perform the assembling so as to suppress the second term to be as small as possible. On the other hand, b of the first term depends on a design condition. Accordingly, it can be known that the design may be performed on a dimensional condition that the distance 2b in FIG. 10 is reduced to be as small as possible, in order to reduce the moment N of the expression (13) to suppress the tilting of the armature 13.

Figure 11:
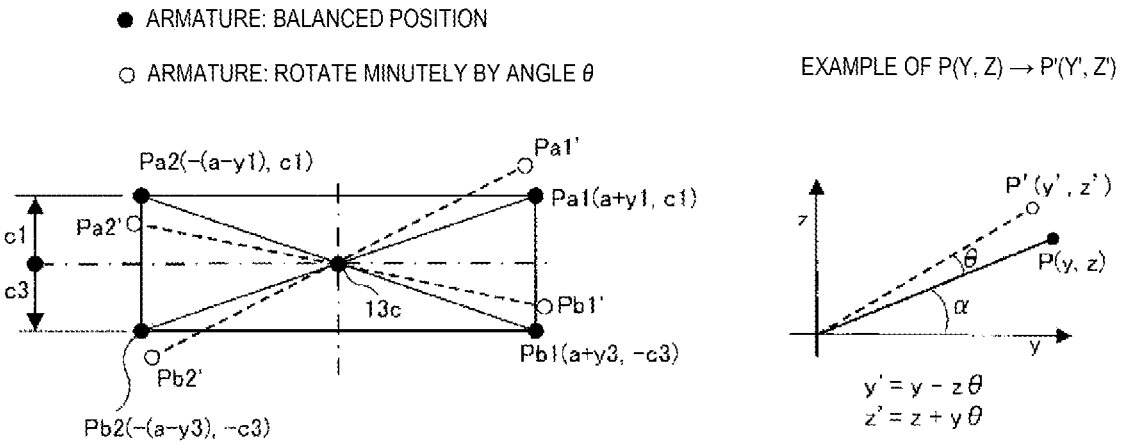
FIG. 11 A view of a case where virtual minute rotation is assumed in the armature in a balanced state.

Next, assume a case where the armature 13 in the balanced state has tilted. FIG. 11 schematically shows a state on this occasion, in which the armature 13 is assumed to have virtually rotated around the center axis 13*c* by only a minute angle θ in a counterclockwise direction. In FIG. 11, the forces by which the upper and lower spring members 14*a* and 14*b* press the armature 13 are −Fa1, −Fa2, +Fb1 and +Fb2, and initial application points Pa1, Pa2, Pb1 and Pb2 of the forces −Fa1, −Fa2, +Fb1 and +Fb2 are assumed to have changed to application points Pa1', Pa2', Pb1' and Pb2' after the minute rotation of the angle θ. When, for example, a point P (y, z) changes to a point P'(y', z') in a YZ plane, as shown on the right side of FIG. 11, y'=y−zθ and z'=z+yθ are established. Accordingly, the changes of the application points are respectively expressed by the following expressions (14), (15), (16) and (17) including YZ-coordinates.

$$Pa1(a+y1,c1)\rightarrow Pa1'(a+y1-c1\theta,c1+(a+y1)\theta) \quad (14)$$

$$Pa2(-(a-y1),c1)\rightarrow Pa2'(-(a-y1)-c1\theta,c1-(a-y1)\theta) \quad (15)$$

$$Pb1(a+y3,-c3)\rightarrow Pb1'(a+y3+c3\theta,-c3+(a+y3)\theta) \quad (16)$$

$$Pb2(-(a-y3)-c3)\rightarrow Pb2'(-(a-y3)+c3\theta,-c3-(a-y3)\theta) \quad (17)$$

in which c1: a z-coordinate of the application points Pa1 and Pa2 c3: a z-coordinate of the application points Pb1 and Pb2

From the results of the aforementioned expressions (14) to (17), it is shown that when the armature 13 in the balanced state makes minute rotation, a moment of a force tending to undo the rotation acts on the armature 13. This is clear from a point that, against the minute rotation of the angle θ, forces acting on the application points Pa1 and Pb2 in a direction to undo the rotation increase whereas forces reversely acting on the application points Pa2 and Pb1 decrease. This matter will be examined as follows in more detail.

Assume that a deflection amount on the right side of the upper spring member 14*a* is ua1, a deflection amount on the left side of the upper spring member 14*a* is ua2, a deflection amount on the right side of the lower spring member 14*b* is ub1 and a deflection amount on the left side of the lower spring member 14*b* is ub2. In this case, changes caused by the minute rotation of the angle θ can be expressed by the following expressions (18), (19), (20) and (21).

$$ua1\rightarrow ua1'=ua1++(a+y1)\theta\approx ua1+a\theta \quad (18)$$

$$ua2\rightarrow ua2'=ua2-(a-y)\theta\approx ua2-a\theta \quad (19)$$

$$ub1\rightarrow ub1'=ub1-(a+y3)\theta\approx ub1-a\theta \quad (20)$$

$$ub2\rightarrow ub2'=ub2+(a-y3)\theta\approx ub2+a\theta \quad (21)$$

On the other hand, when stiffnesses of the spring members 14*a* and 14*b* according to the application points Pa1, Pa2, Pb1 and Pb2 of the forces Fa1, Fa2, Fb1 and Fb2 acting on the spring members 14*a* and 14*b* are sa1, sa2, sb1 and sb2 respectively, the forces Fa1, Fa2, Fb1 and Fb2 can be expressed by the following expressions (22), (23), (24) and (25).

$$Fa1=sa1-ua1 \tag{22}$$

$$Fa2=sa2\cdot ua2 \tag{23}$$

$$Fb1=sb1\cdot ub1 \tag{24}$$

$$Fb2=sb2\cdot ub2 \tag{25}$$

Therefore, the following expressions (26), (27), (28) and (29) can be respectively derived from the expressions (22) to (25) and the expressions (18) to (21) due to the minute rotation of the angle θ.

$$Fa1'=sa1\cdot ua1'\approx Fa1+sa1\cdot a\theta \tag{26}$$

$$Fa2'=sa2\cdot ua2'\approx Fa2-sa2-a\theta \tag{27}$$

$$Fb1'=sb1-ub1'\approx Fb1-sb1-a\theta \tag{28}$$

$$Fb2'=sb2\cdot ub2'\approx Fb2+sb2\cdot a\theta \tag{29}$$

That is, forces −Fa1', −Fa2', +Fb1' and +Fb2' act on the armature 13 respectively due to the minute rotation of the angle θ. Accordingly, a moment N(θ) of a force that tends to undo the rotation can be expressed by the following expression (30).

$$N(\theta)\approx Fa1'(a+y1')-Fa2'(a-y1')-Fb1'(a+y3')+Fb2'(a-y3') \tag{30}$$

Here, the y1' and y3' are obtained by the following expressions (31) and (32) from the expressions (14) to (17).

$$y1'=y1-c1\theta \tag{31}$$

$$y3'=y3+c3\theta \tag{32}$$

When the expressions (26) to (29) and the expressions (31) and (32) are substituted into the expression (30), and minute quantities of quadratic or higher items are ignored to arrange the expression (30), the following expression (33) is derived.

$$N(\theta)=Fa1'(a+y1')-Fa2(a-y1)-Fb1(a+y3)+Fb2(a-y3)-(Fa1+Fa2)c1\theta-(Fb1+Fb2)c3\theta+(sa1+sa2+sb1+sb2)a^2\theta \tag{33}$$

The first four terms in the expression (33) are 0 according to the expression (6). Further, when the expression (5) is applied to the fifth term and the sixth term of the expression (33), the following expression (34) is derived.

$$N(\theta)\approx(sa1+sa2+sb1+sb2)a^2\theta-(Fa1+Fa2)(c1+c3)\theta \tag{34}$$

However, the relationship of the following expression (35) is established $$c1\approx c3\approx c \tag{35}$$

Further, the following expressions (36) and (37) can be placed.

$$sa1\approx sa2\approx sb1\approx sb2\approx s \tag{36}$$

$$ua1\approx ua2\approx ub1\approx ub2=u \tag{37}$$

Therefore, the expression (3) can be expressed by the following expression (38).

$$N(\theta)\approx 4s(a^2-uc)\theta \tag{38}$$

In the expression (38), normally, a>c and a>>u are established. Accordingly, the following expression (39) is established.

$$a^2-uc\approx a^2>0 \tag{39}$$

That is, in response to the minute rotation of the angle θ, the moment N(θ) of the force acts in a direction undo the rotation. Therefore, it can be understood that in order to increase the moment N(θ) in the expression (38) to make the armature 13 difficult to tilt, design may be performed on a dimensional condition that the distance 2a in FIG. 10 is increased to be as large as possible.

As the measure against the tilting of the armature 13 in the electromechanical transducer according to the present embodiment, as described above, design is required to be made to reduce the distance 2b and increase the distance 2a. In FIG. 10, at least a dimensional condition of 2a>2b has to be satisfied. However, as a result of examination by the present inventors, it has been known that the distance 2a is effectively set to be two times or more than the distance 2b, in order to obtain performance required for the electromechanical transducer. In the present embodiment, the distance 2a and the distance 2b are set to have such a dimensional relationship. Thus, the resultant forces applied to the armature 13 and the moments thereof are balanced to suppress rotation of the armature 13 around the central axis 13*c* to thereby make the armature 13 difficult to tilt. Accordingly, desired performance can be always secured. Further, when the size of the armature 13 is increased, deterioration of the performance caused by the tilting of the armature 13 becomes a major problem. By setting the aforementioned dimensional relationship, the performance can be improved regardless of the size of the armature 13.

Figure 12:
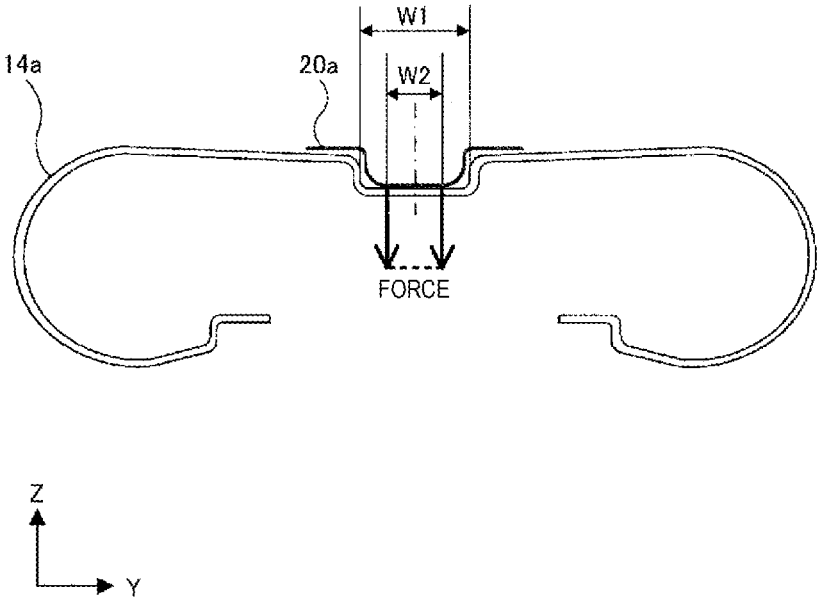
FIG. 12 A view showing a schematic structure example of a portion in which a spring member same as that of FIG. 10 is engaged with an anchor member having a rounded sectional shape in the present embodiment.

Next, in order to explain the structure shown in FIG. 10 from a different viewpoint, FIG. 12 shows a schematic structure example of a portion where a spring member 14*a* shown in FIG. 10 is engaged with an anchor member 20*a* having a rounded sectional shape. In the structure example of FIG. 12, a downward force in the Z-direction acts on the spring member 14*a* through the anchor member 20*a*. In this case, the sectional shape of the anchor member 20*a* is rounded. Accordingly, a width W2 in the Y-direction of a range on which a force acts in an area near the center of the anchor member 20*a* with respect to a width W1 in the Y-direction of an engagement portion E1 holds a relationship of W1>W2. When such a structure example is assumed, the effect of the present invention can be realized as long as the aforementioned distance 2a (second distance) is set to be two times or more than the width W2 (as a first distance) corresponding to the aforementioned distance 2b.

Figure 13:
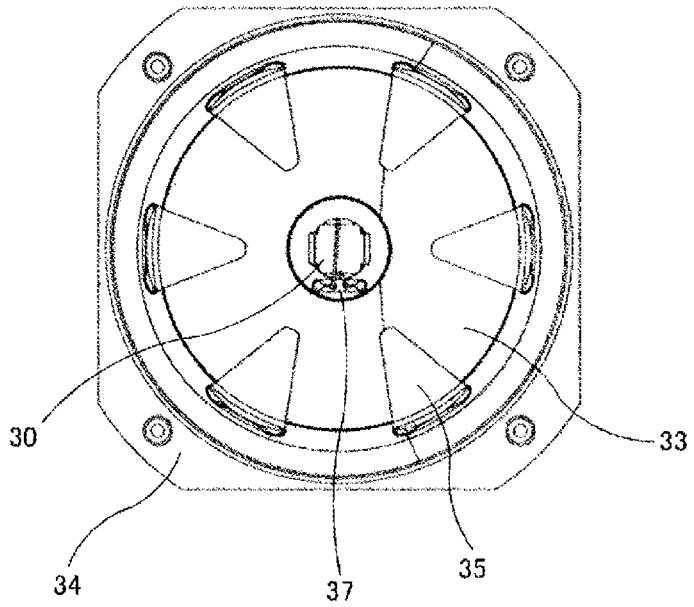
FIG. 13 A front view showing an overall structure of a speaker unit according to the present embodiment.
Figure 14:
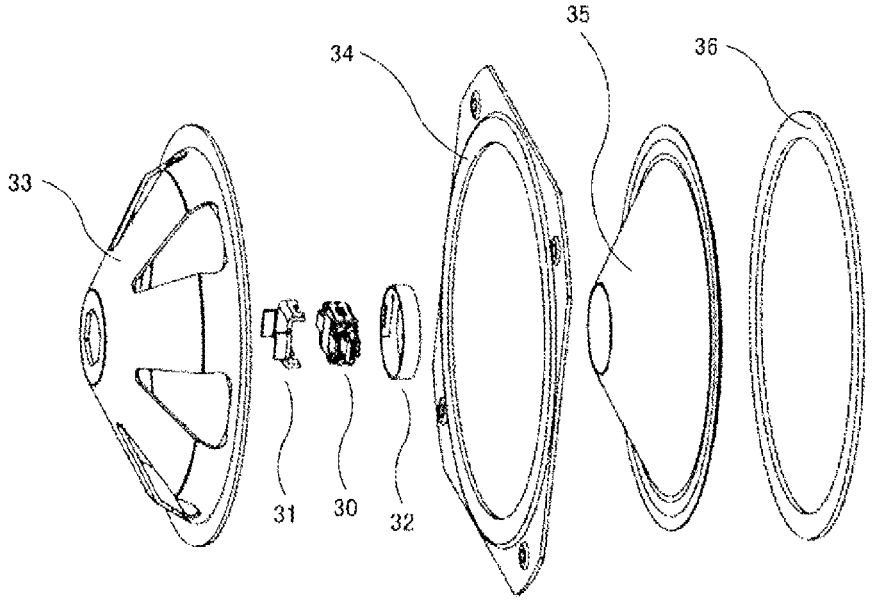
FIG. 14 An exploded perspective view of the speaker unit in FIG. 13.

Next, an embodiment of a speaker unit to which the present invention is applied will be described as an example of an electroacoustic transducer that converts an electric signal into sound and outputs the converted sound to the outside. FIG. 13 is a front view showing an overall structure of the speaker unit according to the present embodiment. FIG. 14 is an exploded perspective view of the speaker unit in FIG. 13. In the speaker unit shown in FIGS. 13 and 14, the electromechanical transducer according to the present invention is mounted as a driving unit 30. In the driving unit 30, a coupling member 31 is fixed to the yoke 10 by welding or the like, and a connecting ring 32 is fixed to the opposite ends of the armature 13 by adhesive bonding or the like.

In addition, a frame 33 is fixed to an attachment plate 34 by welding or the like. An outer circumferential portion of a diaphragm 35 is fixed to the attachment plate 34 by adhesive bonding or the like while being pressed by a pressing ring 36. The coupling member 31 fixed to the driving unit 30 is fixed to the frame 33 by welding or the like. Finally, the connecting ring 32 and the diaphragm 35 are fixed by adhesive bonding or the like. Further, an electric terminal 37 fixed to the frame 33 is connected to an electric terminal of the driving unit 30 through a lead wire (not shown). Thus, the entire speaker unit is configured.

The electromechanical transducer and the electroacoustic transducer according to the present invention have been described above based on the present embodiment. However, the present invention is not limited to the aforementioned embodiment, but various changes can be made without departing from the gist of the present invention. For example, the electromechanical transducer according to the present invention can be applied to a hearing aid that can be worn in a cavum concha of a user's ear. Thus, both sounds generated due to the vibration itself of the electromechanical transducer and due to vibration of the housing of the electromechanical transducer can be made to function as transmission means, so that the sounds can be transmitted to the user's ear.

REFERENCE SIGNS LIST

10, 11 . . . , yoke
12 . . . coil
13 . . . armature
14 . . . spring member
15 . . . magnet
20, 23, 24 . . . anchor member
22 . . . reinforcement plate
30 . . . driving unit
31 . . . coupling member
32 . . . connecting ring
33 . . . frame
34 . . . attachment plate
35 . . . diaphragm
36 . . . pressing ring
37 . . . electric terminal

The invention claimed is:

1. An electromechanical transducer that converts an electric signal into mechanical vibration, the electromechanical transducer comprising:

a structure portion in which at least a pair of magnets, a yoke and a coil are integrally arranged, wherein magnetic fluxes generated by the magnets are guided by the yoke and the electric signal is supplied to the coil;

an armature in which an inner portion penetrating an internal space of the structure portion along a central axis extending in a first direction, and outer portions protruding from opposite sides of the inner portion are formed, and that configures a magnetic circuit with the structure portion through two regions of the inner portion to which the magnetic fluxes reverse to each other are guided so that the armature is displaced in a second direction orthogonal to the first direction by magnetic force of the magnetic circuit; and elastic members that are arranged symmetrically to each other in the second direction across each of the outer portions on the opposite sides to give restoring forces respectively to the outer portions in accordance with the displacement of the armature generated by the magnetic force of the magnetic circuit, wherein a first engagement portion engaged with the structure portion and second engagement portions engaged with each of the outer portions are formed in each of the elastic members, and wherein when a direction perpendicular to the first direction and the second direction is set as a third direction:

a width on which a force in the second direction acts between each of the elastic members and the structure portion through the first engagement portion has a first distance in the third direction;

a width on which a force in the second direction acts between each of the elastic members and each of the outer portions through the second engagement portions has a second distance in the third direction; and the second distance is set to be two times or more than the first distance.

2. An electromechanical transducer that converts an electric signal into mechanical vibration, the electromechanical transducer comprising:

a structure portion in which at least a pair of magnets, a yoke and a coil are integrally arranged, wherein magnetic fluxes generated by the magnets are guided by the yoke and the electric signal is supplied to the coil;

an armature in which an inner portion penetrating an internal space of the structure portion along a central axis extending in a first direction, and outer portions protruding from opposite sides of the inner portion are formed, and that configures a magnetic circuit with the structure portion through two regions of the inner portion to which the magnetic fluxes reverse to each other are guided so that the armature is displaced in a second direction orthogonal to the first direction by magnetic force of the magnetic circuit; and elastic members that are arranged symmetrically to each other in the second direction across each of the outer portions on the opposite sides to give restoring forces respectively to the outer portion in accordance with the displacement of the armature generated by the magnetic force of the magnetic circuit, wherein a first engagement portion engaged with the structure portion and second engagement portions engaged with each of the outer portions are formed in each of the elastic members, and wherein when a region including each of the elastic members, the structure portion and each of the outer portions is divided into a first region and a second region by a plane including the central axis and parallel to the first direction and the second direction, and a direction perpendicular to the first direction and the second direction is set as a third direction:

when a force acting in the second direction between each of the elastic members and the structure portion through the first engagement portion is expressed by a first resultant force acting on a first application point of the first region and a second resultant force acting on a second application point of the second region, and a force acting in the second direction between each of the elastic members and each of the outer portions through the second engagement portions is expressed by a third resultant force acting on a third application point of the first region and a fourth resultant force acting on a fourth application point of the second region; and a second distance between the third application point and the fourth application point is set to be two times or more than a first distance between the first application point and the second application in the third direction.

3. The electromechanical transducer according to claim 1, wherein anchor members with which the elastic members are engaged through the first engagement portions respectively are attached to regions of the yoke on opposite sides in the first direction.

4. The electromechanical transducer according to claim 3, wherein each of the anchor members is substantially formed into a rectangular sectional shape having a width equal to the first distance.

5. The electromechanical transducer according to claim 4, wherein cutout portions with which the elastic members are engaged through the second engagement portions are formed in the outer portions on the opposite sides of the armature.

6. The electromechanical transducer according to claim 5, wherein the first engagement portion engaged with the anchor member and the second engagement portions engaged with the two cutout portions of the outer portion are formed in each of the elastic members.

7. The electromechanical transducer according to claim 1, wherein each of the elastic members is a spring member formed by bending a plate-like member.

8. An electroacoustic transducer comprising:

the electromechanical transducer according to claim 1; and a diaphragm that generates sound pressure according to vibration generated by the electromechanical transducer.

* * * * *